US012151873B2

(12) United States Patent
Guilkey

(10) Patent No.: US 12,151,873 B2
(45) Date of Patent: Nov. 26, 2024

(54) INSULATED CONTAINERS AND RELATED METHODS

(71) Applicant: Laird Avenue Consulting, LLC, Salt Lake City, UT (US)

(72) Inventor: James Guilkey, Salt Lake City, UT (US)

(73) Assignee: Laird Avenue Consulting, LLC, Salt Lake City, UT (US)

( * ) Notice: Subject to any disclaimer, the term of this patent is extended or adjusted under 35 U.S.C. 154(b) by 0 days.

(21) Appl. No.: 18/066,017

(22) Filed: Dec. 14, 2022

(65) Prior Publication Data

US 2024/0199308 A1 Jun. 20, 2024

(51) Int. Cl.
*B65D 81/38* (2006.01)

(52) U.S. Cl.
CPC ..... *B65D 81/3874* (2013.01); *B65D 81/3869* (2013.01)

(58) Field of Classification Search
CPC ..... B65D 81/3869; B65D 81/3872; B65D 81/3874; B65D 81/3886; B65D 81/3893; B65D 81/3897; B65D 2581/3437; B65D 2581/3439; B65D 41/3461; Y10T 428/24281
See application file for complete search history.

(56) References Cited

U.S. PATENT DOCUMENTS 2,876,634 A 3/1959 Zimmerman et al.
3,225,820 A 12/1965 Riordan
5,243,835 A 9/1993 Padamsee
6,191,393 B1 * 2/2001 Park ..... A47J 27/002 220/619
6,367,652 B1 * 4/2002 Toida ..... B65D 25/2811 220/592.16
6,968,888 B2 11/2005 Kolowich
8,146,797 B2 4/2012 D'Amato
9,181,015 B2 11/2015 Booska
9,782,036 B2 10/2017 Alexander
D804,905 S 12/2017 Seiders et al.
11,129,499 B2 9/2021 Tolman et al.
(Continued)

FOREIGN PATENT DOCUMENTS

CN 102381520 A 3/2012
CN 104887011 B 9/2016
(Continued)

OTHER PUBLICATIONS

International Search Report and Written Opinion for International Application No. PCT/US23/78534, mailed Mar. 28, 2024, 13 pages.

*Primary Examiner* — Jeffrey R Allen
(74) *Attorney, Agent, or Firm* — Ray, Quinney & Nebeker; Daniel J. Bezdjian

(57) ABSTRACT

An insulated container for a beverage comprises an inner wall defining an opening and a volume, an outer wall surrounding the inner wall and defining a cavity between the inner wall and the outer wall, and one or more heat transfer devices within the cavity and attached to the inner wall, the one or more heat transfer devices spaced from the outer wall and configured to contact the outer wall responsive to exceeding a temperature greater than a predetermined temperature. Related insulated containers and methods are also disclosed.

19 Claims, 7 Drawing Sheets

(56) References Cited

U.S. PATENT DOCUMENTS

| | | | | |
|---|---|---|---|---|
| 11,206,938 | B2 | 12/2021 | Booska | |
| 2005/0053776 | A1* | 3/2005 | Blonder | A63H 33/00 374/E1.002 |
| 2010/0108694 | A1 | 5/2010 | Sedlbauer et al. | |
| 2013/0255824 | A1 | 10/2013 | Williams et al. | |
| 2016/0332799 | A1 | 11/2016 | Kolowich et al. | |
| 2022/0211197 | A1 | 7/2022 | Spivey et al. | |
| 2022/0322860 | A1 | 10/2022 | Taylor | |
| 2022/0388729 | A1* | 12/2022 | McCluskey | B65D 51/1611 |

FOREIGN PATENT DOCUMENTS

| | | | |
|---|---|---|---|
| CN | 104687949 | B | 10/2016 |
| CN | 104367108 | B | 1/2017 |
| CN | 106821046 | | 6/2017 |
| CN | 110063663 | | 7/2019 |
| CN | 211066034 | U | 7/2020 |
| CN | 115281541 | | 11/2022 |
| DE | 102004055311 | B3 | 1/2006 |
| EP | 2727503 | B1 | 4/2016 |
| WO | 2008/107657 | A1 | 9/2008 |
| WO | 2018/132510 | A1 | 7/2018 |

* cited by examiner

INSULATED CONTAINERS AND RELATED METHODS

TECHNICAL FIELD

Embodiments of the disclosure relate generally to insulated containers configured to hold a liquid, such as a beverage. More particularly, embodiments of the disclosure relate to insulated containers configured to hold a liquid and including a heat transfer device between an inner wall and an outer wall thereof.

BACKGROUND

There have been many attempts to maintain the temperature of a liquid (e.g., a hot liquid, such as coffee, tea, and hot water) within a particular temperature range suitable for human consumption of the liquid. Some beverages, such as coffee and tea, are prepared and served at temperatures above safe drinking temperatures and above temperatures at which consumers prefer to consume them. Typically, the consumer must wait for a duration for the beverage to cool to a suitable temperature before consuming the beverage, otherwise, the consumer risks burning their mouth with the beverage. However, if the beverage is cooled below a certain temperature, the consumer may not enjoy the beverage. Thus, many beverages are desired to be consumed within a particular temperature range that is not too hot and not too cold.

In an effort to speed the cooling process, some attempt to rapidly cool a hot beverage and maintain the temperature of the beverage within an acceptable drinking range. For instance, some have used ice or a cool liquid (e.g., water or milk) to cool a hot beverage. However, use of other liquids dilutes the beverage, or may cool the temperature of the beverage below the temperature desired by the consumer. Other methods of cooling a beverage including pouring the beverage into a cool container. However, such methods are imprecise and are not suitable for achieving a desired temperature range consistently. Further, once the beverage reaches a suitable temperature, the beverage continues to lose heat to the surrounding environment, reducing the duration at which the beverage is within a desired temperature range for consumption.

The primary method of slowing the cooling rate of a liquid in a container has been to insulate the container from the surrounding environment. In this regard, many have used foam insulated containers or vacuum insulated containers. Foam insulated containers are not suitable for maintaining the beverage temperature within a desired range for durations longer than about one hour. In addition, foam insulated containers are disposable and increase waste. Vacuum insulated containers may maintain the temperature of the liquid, but may not reduce the temperature of the liquid to a suitable drinking temperature at a sufficient rate, such that the consumer must wait for an extended period of time prior to consumption.

BRIEF SUMMARY

In accordance with one embodiment described herein, an insulated container for a beverage comprises an inner wall defining an opening and a volume, an outer wall surrounding the inner wall and defining a cavity between the inner wall and the outer wall, and one or more heat transfer devices within the cavity and attached to the inner wall, the one or more heat transfer devices spaced from the outer wall and configured to contact the outer wall responsive to exceeding a temperature greater than a predetermined temperature.

In additional embodiments, an insulated container comprises an inner vessel and an outer vessel. The inner vessel comprises an internal lower surface and an inner wall vertically extending from the internal lower surface. The outer vessel comprises an external lower surface and outer walls vertically extending from the external lower surface and connected to the inner walls at an upper portion of the insulated container. The insulated container further comprises one or more metallic strips attached to the inner vessel and spaced from the outer vessel, the one or more metallic strips within a cavity between the inner vessel and the outer vessel.

In further embodiments, a method of maintaining a temperature of a liquid in an insulated container for a duration comprises transferring thermal energy from a liquid in an internal volume through an inner wall to one or more heat transfer devices in contact with the inner wall, increasing the temperature of the one or more heat transfer devices and causing the one or more heat transfer devices to contact an outer wall surrounding the inner wall, conductively transferring thermal energy from the one or more heat transfer devices to the outer wall, and breaking contact between the one or more heat transfer devices and the outer wall responsive to a temperature of the one or more heat transfer devices being reduced to below a predetermined temperature.

DETAILED DESCRIPTION

Figure 1A:
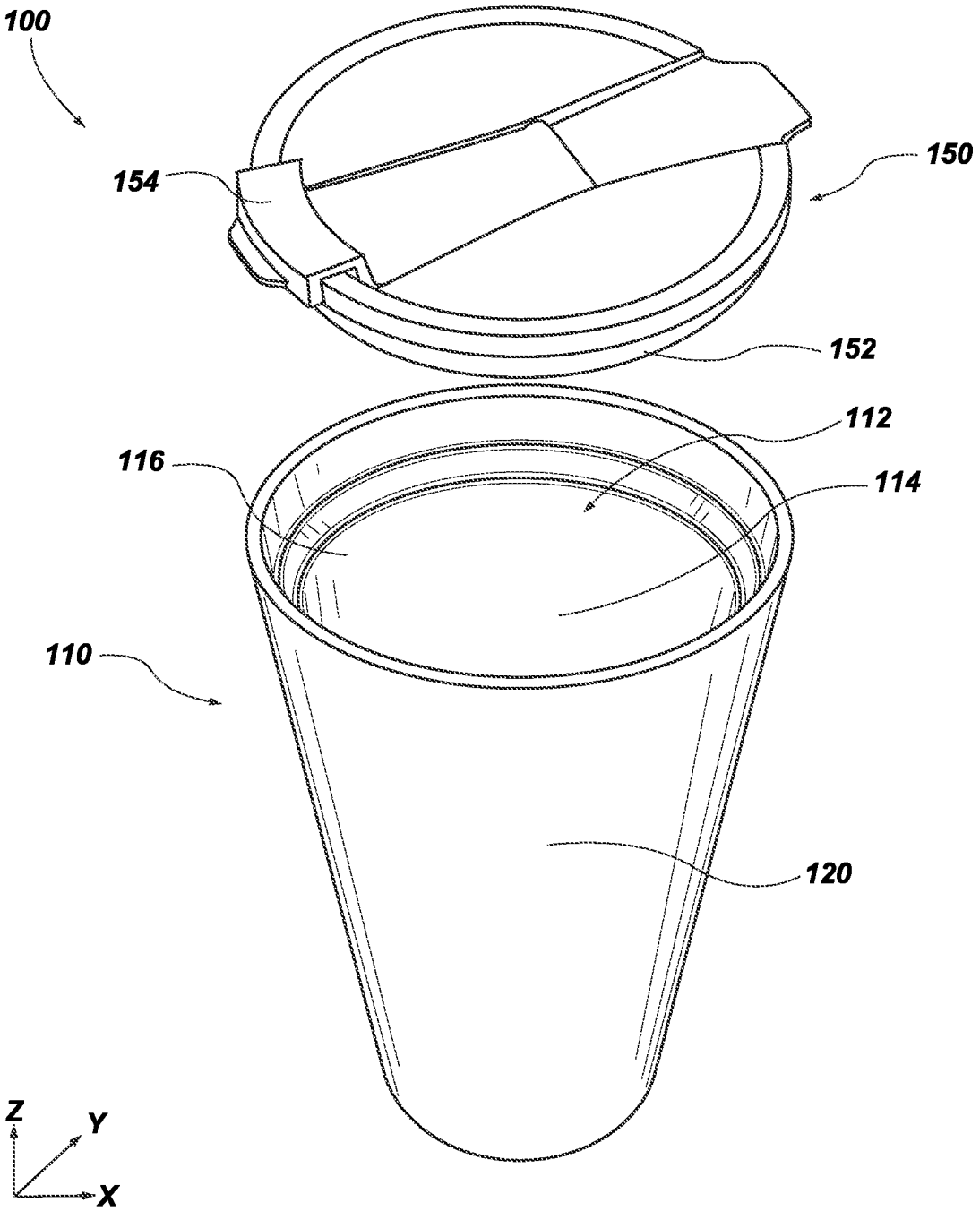
FIG. 1A is a simplified partial perspective view of a set including an insulated container and a lid, in accordance with embodiments of the disclosure.

The following description provides specific details, such as material types, dimensions, and processing conditions in order to provide a thorough description of embodiments of the disclosure. However, a person of ordinary skill in the art will understand that the embodiments of the disclosure may be practiced without employing these specific details. Indeed, the embodiments of the disclosure may be practiced in conjunction with conventional fabrication techniques employed in the industry. In addition, the description provided below does not form a complete process flow, apparatus, or system for forming an insulated container (e.g., an insulated beverage container) including one or more heat transfer devices. Only those process acts and structures necessary to understand the embodiments of the disclosure are described in detail below. Also note, any drawings accompanying the present application are for illustrative purposes only, and are thus not drawn to scale. Additionally, elements common between figures may retain the same numerical designation.

As used herein, the term "configured" refers to a size, shape, material composition, orientation, and arrangement of one or more of at least one structure and at least one apparatus facilitating operation of one or more of the structure and the apparatus in a predetermined way.

As used herein, the term "substantially" in reference to a given parameter, property, or condition means and includes to a degree that one of ordinary skill in the art would understand that the given parameter, property, or condition is met with a degree of variance, such as within acceptable tolerances. By way of example, depending on the particular parameter, property, or condition that is substantially met, the parameter, property, or condition may be at least 90.0 percent met, at least 95.0 percent met, at least 99.0 percent met, at least 99.9 percent met, or even 100.0 percent met.

As used herein, the singular forms "a," "an," and "the" are intended to include the plural forms as well, unless the context clearly indicates otherwise.

As used herein, "and/or" includes any and all combinations of one or more of the associated listed items.

As used herein, "about" or "approximately" in reference to a numerical value for a particular parameter is inclusive of the numerical value and a degree of variance from the numerical value that one of ordinary skill in the art would understand is within acceptable tolerances for the particular parameter. For example, "about" or "approximately" in reference to a numerical value may include additional numerical values within a range of from 90.0 percent to 110.0 percent of the numerical value, such as within a range of from 95.0 percent to 105.0 percent of the numerical value, within a range of from 97.5 percent to 102.5 percent of the numerical value, within a range of from 99.0 percent to 101.0 percent of the numerical value, within a range of from 99.5 percent to 100.5 percent of the numerical value, or within a range of from 99.9 percent to 100.1 percent of the numerical value.

As used herein, spatially relative terms, such as "beneath," "below," "lower," "bottom," "above," "upper," "top," "front," "rear," "left," "right," and the like, may be used for ease of description to describe one element's or feature's relationship to another element(s) or feature(s) as illustrated in the figures. Unless otherwise specified, the spatially relative terms are intended to encompass different orientations of the materials in addition to the orientation depicted in the figures. For example, if materials in the figures are inverted, elements described as "below" or "beneath" or "under" or "on bottom of" other elements or features would then be oriented "above" or "on top of" the other elements or features. Thus, the term "below" can encompass both an orientation of above and below, depending on the context in which the term is used, which will be evident to one of ordinary skill in the art. The materials may be otherwise oriented (e.g., rotated 90 degrees, inverted, flipped, etc.) and the spatially relative descriptors used herein interpreted accordingly.

As used herein, the term "vertical" is in reference to Earth's gravitational field. A "vertical" direction is a direction that is substantially parallel to the Earth's gravitation field. For example, a vertical direction is in a direction between a floor and a building in a conventional dwelling. A "horizontal" or "lateral" direction is a direction that is substantially perpendicular to the vertical direction. With reference to the figures, a "horizontal" or "lateral" direction may be perpendicular to the indicated "Z" axis, and may be parallel to an indicated "X" axis and/or parallel to an indicated "Y" axis; and a "vertical" or "longitudinal" direction may be parallel to an indicated "Z" axis, may be perpendicular to an indicated "X" axis, and may be perpendicular to an indicated "Y" axis.

As used herein, "beverage" means and includes liquids, such as water, coffee, tea, hot chocolate, mulled wine, soup (e.g., instant noodles), sauce, or other liquids that may be consumed. The viscosity of the liquid at about 25° C. may be less than about 10,000 centipoise (cP), less than about 5,000 cP, less than about 1,000 cP, less than about 100 cP, less than 10 cP, or less than about 5 cP.

According to embodiments described herein, an insulated container (e.g., an insulated beverage container) is configured to facilitate cooling of a liquid to a temperature within a predetermined temperature range, and extend a duration at which the liquid remains within the predetermined temperature range. The insulated container includes an inner container defined by inner walls and an internal lower surface. An outer vessel surrounds the inner vessel and is defined by outer walls and an external lower surface. The inner walls and the outer walls converge at an upper portion of the insulated container and form a lip of the insulated container. A cavity between the inner vessel and the outer vessel (e.g., between the inner walls and the outer walls, and between the internal lower surface and the external lower surface) is vacuum insulated. One or more heat transfer devices are attached (e.g., secured, welded, clamped, adhered) to the inner vessel and spaced from the inner vessel. Responsive to exposure to a temperature greater than a predetermined temperature (e.g., greater than about 60° C. (about 140° F.), or greater than about 70° C. (about 158° F.), such as responsive to a hot liquid placed within a volume defined by the inner vessel), the one or more heat transfer devices change in shape (e.g., bend, deform, flex, deflect). Responsive to the change in shape, the one or more heat transfer devices contact the outer vessel, facilitating conductive heat transfer from the one or more heat transfer devices to the outer vessel, and from the outer vessel to the external environment, increasing the rate of cooling of the liquid in the inner vessel. After the temperature of the liquid in the volume defined by the inner vessel has been reduced below the predetermined temperature (and the corresponding temperature of the one or more heat transfer devices has exhibited a corresponding decrease below the predetermined temperature), the one or more heat transfer devices may return to their original location separated from the outer vessel.

Accordingly, the one or more heat transfer devices may break contact with the outer vessel responsive to exposure to a temperature below the predetermined temperature, to reduce the rate of thermal transfer and cooling of the liquid in the volume. The one or more heat transfer devices may be formulated and configured to contact the outer vessel above the predetermined temperature, which may correspond to a desired temperature for consumption of the liquid (e.g., coffee, tea, hot water). The one or more heat transfer devices may, therefore, facilitate cooling of the liquid by conductive heat transfer until the temperature of the liquid is reduced below the predetermined temperature, at which point the one or more heat transfer devices do not contact the outer vessel and do not substantially transfer thermal energy from the liquid to the surrounding environment by conductive heat transfer, increasing the duration at which the liquid temperature is maintained below the predetermined temperature and above reduced temperatures at which it may be undesirable to consume the liquid. In some embodiments, the one or more heat transfer devices facilitate rapidly cooling the temperature of a liquid to a safe and desirable drinking temperature (e.g., between about 60° C. and about 70° C.) and maintaining the temperature of the liquid within a range of safe and desirable drinking temperatures for an extended duration. Further, in the event that a liquid having a temperature higher than a safe drinking temperature is introduced into the insulated container, the one or more heat transfer devices may facilitate the rapid removal of heat from the liquid to bring the temperature of the liquid to within a temperature range that is safe for consumption.

FIG. 1A is a simplified partial perspective view of a set 100 including an insulated container 110 and a lid 150, in accordance with embodiments of the disclosure. The insulated container 110 may also be referred to herein as a "receptacle," a "liquid receptacle," a "container," a "double-walled" container, a "flask," a "vessel," a "mug," a "tumbler," or a "cup."

The insulated container 110 is configured to contain (e.g., store) a volume of liquid. The insulated container 110 includes an inner vessel 105 and an outer (external) vessel 115 surrounding the inner vessel 105. The inner vessel 105 and the outer vessel 115 converge at an upper portion 124 (e.g., in the Z-direction) of the insulated container 110 to define a lip 126. The upper portion 124 defines an opening 112 to receive the liquid. An internal volume 114 (also referred to as an "internal reservoir") is configured to contain the volume of the liquid.

The lid 150 comprises a seal 152 configured to interact with the opening 112. The seal 152 may comprise, for example, an O-ring configured to seal the lid 150 to the insulated container 110. The lid 150 may further include a cover 154 configured to open and close or slide. The cover 154 overlies an opening of the lid 150 through which liquid from the insulated container 110 flows during use and operation (e.g., drinking from) the insulated container 110. The cover 154 and the seal 152 may substantially reduce convective thermal losses from a liquid within the insulated container 110 through the opening 112.

Figure 1B:
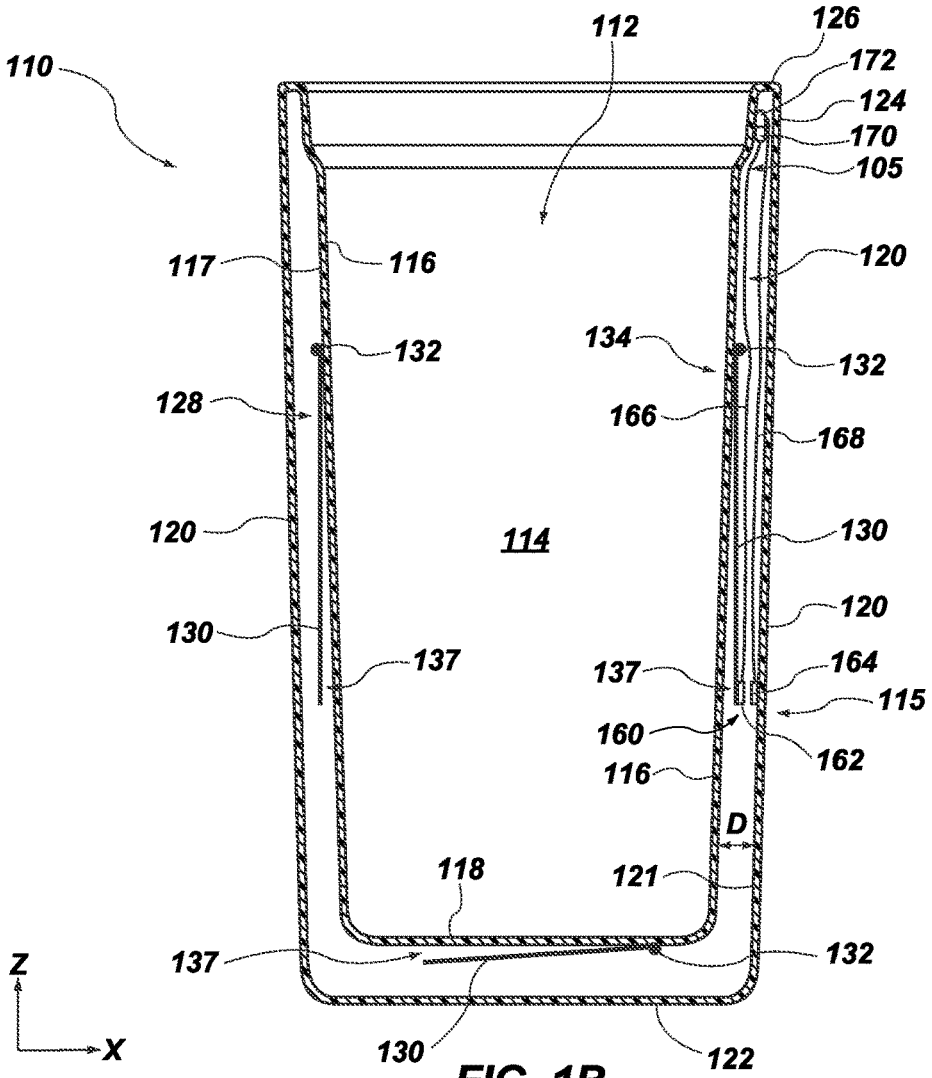
FIG. 1B is a simplified partial cross-sectional view of the insulated container of FIG. 1A, in accordance with embodiments of the disclosure.

FIG. 1B is a simplified partial cross-sectional view of the insulated container 110, in accordance with embodiments of the disclosure. With collective reference to FIG. 1A and FIG. 1B, the inner vessel 105 comprises an inner wall 116 and an internal lower surface 118 connecting the inner walls 116 to one another. The inner wall 116 and the internal lower surface 118 define the internal volume 114 configured to contain the liquid.

The outer vessel 115 surrounds the inner vessel 105 and comprises an outer wall 120 surrounding the inner wall 116, and an external lower surface 122 vertically spaced (e.g., in the Z-direction) from the internal lower surface 118. The outer wall 120 may also be referred to as an "outer shell." The external lower surface 122 extends between and connects the outer wall 120. The external lower surface 122 may be sized, shaped, and configured to support the insulated container 110 in an upright position. In some embodiments, the external lower surface 122 comprises a substantially planar surface to facilitate support of the insulated container 110 on a surface.

The outer wall 120 and the inner wall 116 may form a so-called "double-walled" container. Thus, the insulated container 110 may be referred to as a "double-walled" receptacle.

The inner wall 116, the internal lower surface 118, the outer wall 120, and the external lower surface 122 may individually be formed of and comprise substantially the same material composition. The inner wall 116, the internal lower surface 118, the outer wall 120, and the external lower surface 122 may individually comprise stainless steel (e.g., 304 stainless steel (also referred to as 18/8 stainless steel (e.g., comprising an alloy of from about 17.5 weight percent chromium to about 19.5 weight percent chromium, from about 8 weight percent nickel to about 10.5 weight percent nickel, about 2.0 weight percent manganese, about 1.0 weight percent silicon, minor amounts of carbon, phosphorous, sulfur, and nitrogen, the remainder comprising iron), 316 stainless steel, 430 stainless steel), aluminum, an alloy of aluminum, copper, an alloy of copper, or a plastic material (e.g., high impact polystyrene (HIPS). In some embodiments, the inner wall 116, the internal lower surface 118, the outer wall 120, and the external lower surface 122 individually comprise a metal.

In some embodiments, outer surfaces 117 of the inner wall 116 may be coated with a coating configured to provide insulation to the inner wall 116 and reduce heat transfer from the inner wall 116 to an external environment. In some embodiments, the coating comprises copper.

In some embodiments, inner surfaces 121 of the outer wall 120 are coated with a reflective material. The reflective material may be formulated and configured to reduce an amount of radiative heat loss from the inner wall 116 to the outer wall 120. In some embodiments, the reflective material comprises silver.

A cavity 128 is defined between the inner vessel 105 and the outer vessel 115. In some embodiments, the cavity 128 is defined between the inner wall 116 and the outer wall 120, and in the region between the internal lower surface 118 and the external lower surface 122. The cavity 128 may exhibit an annular shape between the inner wall 116 and the outer wall 120 and may be referred to as an "annular cavity."

The cavity 128 may comprise a vacuum sealed region. In some embodiments, the cavity 128 is substantially free of vapor (e.g., gases, such as air) and may comprise a vacuum. In some such embodiments, the insulated container 110 may be referred to as a "vacuum insulated" container. Removing or reducing the vapor (e.g., reducing the pressure of gases in the cavity 128), such as air, from the cavity 128 may substantially reduce the rate of conductive heat transfer from the inner wall 116 to the outer wall 120, and from the outer wall to an external environment.

Figure 1C:
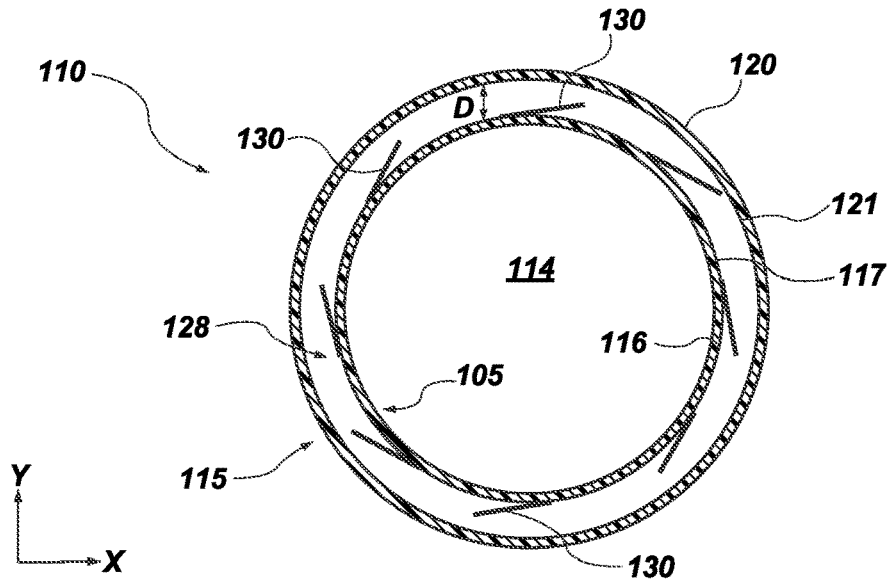
FIG. 1C is a simplified partial top-down view of the insulated container of FIG. 1B.

FIG. 1C is a simplified partial top-down view of the insulated container 110 taken through section line C-C of FIG. 1B. With collective reference to FIG. 1B and FIG. 1C, one or more heat transfer devices 130 may be located within the cavity 128 and on the inner vessel 105, such as on the inner wall 116, on the internal lower surface 118, or both. The heat transfer devices 130 may be configured to selectively transfer heat from the inner vessel 105 to the outer vessel 115. In some embodiments, the heat transfer devices 130 are configured to transfer thermal energy from the inner wall 116 to the outer wall 120. In some embodiments, at least one of the heat transfer devices 130 is configured to transfer heat from the internal lower surface 118 to the external lower surface 122. Heat from the outer wall 120 and the external lower surface 122 may be transferred to the external environment.

In some embodiments, the one or more heat transfer devices 130 are secured to (e.g., attached) to outer surfaces 117 of the inner wall 116 and are spaced (e.g., radially spaced) from the inner surface 121 of the outer wall 120. In some embodiments, when the insulated container 110 is at room temperature (e.g., between about 20° C. and about 25° C.), the one or more heat transfer devices 130 do not contact the outer wall 120. As described in further detail herein, the one or more heat transfer devices 130 may be sized, shaped, and configured to selectively contact the inner surface 121 of the outer wall 120 responsive to exposure to a temperature greater than a predetermined temperature. At temperatures lower than the predetermined temperature, the one or more heat transfer devices 130 selectively break contact with the inner surface 121 of the outer wall 120 to reduce the rate of heat transfer (e.g., conductive heat transfer) from the inner wall 116 to the outer wall 120, and ultimately from the outer wall 120 to the external environment.

In some embodiments, the heat transfer devices 130 are individually attached to inner vessel 105 (e.g., the inner wall 116 and the internal lower surface 118) at joints 132. The joints 132 may be formed by one or more of laser welding, electron beam welding (EBM), arc welding, brazing, of soldering (such as with silver). The joints 132 may comprise a butt weld, a lap weld, or a fillet weld. In other embodiments, the joints 132 comprise an adhesive, such as a thermally conductive adhesive or a thermal adhesive (e.g., a thermal paste). In additional embodiments, the heat transfer devices 130 are mechanically attached to the outer surface and the internal lower surface 118, such as with a mechanical device (e.g., a clamp), or with rivets.

In some embodiments, a first end 134 of each of the heat transfer devices 130 is attached to the inner vessel 105 (e.g., the inner wall 116 or the internal lower surface 118) and a second, opposite end 137 of the heat transfer devices 130 is not attached to the inner vessel 105 (e.g., the inner wall 116 or the internal lower surface 118). In some such embodiments, during use and operation of the insulated container 110, at least a portion (e.g., an end) of each heat transfer device 130 is unattached to a surface defining the cavity 128 and is free to move within the cavity 128 responsive to exposure to a temperature above the predetermined temperature.

With reference to FIG. 1C, the heat transfer devices 130 may be attached to the inner vessel 105 along the circumference of the inner vessel 105 (e.g., along the circumference of the inner walls 116). In some embodiments, the heat transfer devices 130 are substantially evenly spaced along the circumference of the inner vessel 105. In other embodiments, the heat transfer devices 130 may be unevenly spaced from one another along the circumference of the inner vessel 105.

In some embodiments, a heat transfer device 130 may be attached to the inner walls 116 every about 45°. In other embodiments, a heat transfer device 130 may be attached to the inner walls 116 every about 15°, every about 30°, every about 60°, every about 90°, or every about 180°.

With continued reference to FIG. 1B and FIG. 1C, a distance D between the inner wall 116 and the outer wall 120 (e.g., the radial distance defining the cavity 128) may be within a range of from about 794 microns (μm) (about 0.3125 inch) to about 2,381 μm (about 0.0975 inch), such as from about 794 μm (about 0.3125 inch) to about 1,588 μm (about 0.0625 inch), or from about 1,588 μm (about 0.0625 inch) to about 2,381 μm (about 0.0975 inch). However, the disclosure is not so limited and the distance D may be different than those described above.

The distance D and the dimensions of the inner vessel 105 relative to the outer vessel 115 may not be drawn to perspective for clarity and ease of understanding the description. For example, the distance D may be exaggerated to more clearly illustrate the heat transfer devices 130 within the cavity 128. For example, the relative outer diameter of the inner vessel 105 and the inner diameter of the outer vessel 115 may be closer in size to each other than that illustrated in FIG. 1B and FIG. 1C.

Responsive to exposure to a temperature greater than the predetermined temperature, the heat transfer devices 130 may comprise a material formulated and configured to change in shape (e.g., bend, deform, flex, deflect) within the cavity 128 and contact a surface of the outer vessel 115 facing the cavity 128, such as the inner surface 121 of the outer wall 120 or the inner surface of the external lower surface 122. In some embodiments, the exposure to the temperature may be as a result of thermal transfer from a liquid (e.g., coffee, tea, hot water) in the internal volume 114 through the inner wall 116 and the internal lower surface 118 and to the heat transfer devices 130.

With reference to FIG. 1B, in some embodiments, a switch 160 is operably coupled to at least one of the heat transfer devices 130. The switch 160 includes, for example, a first contact pad 162 attached to the heat transfer device 130, a second contact pad 164 attached to the outer vessel 115 (e.g., to the outer wall 120) opposite the first contact pad 162, a first wire 166 attached to the first contact pad 162 and extending to a first contact 170, and a second wire 168 attached to the second contact pad 164 and extending to a second contact 172 electrically isolated from the first contact 170. In some embodiments, the first contact 170 and the second contact 172 are provided in the same package, but are electrically isolated from each other, such that one structure may be attached to the surface of the upper portion 124, such as on the surface of the lip 126.

In some embodiments, the first contact pad 162 is attached to the heat transfer device 130 with a non-conductive epoxy and the second contact pad 164 is attached to the heat transfer device 130 with a non-conductive epoxy. The first wire 166 may be soldered to the first contact pad 162 and to the first contact 170. The second wire 168 may be soldered to the second contact pad 164 and to the second contact 172.

As described in further detail herein, when the heat transfer devices 130 deform responsive to exposure to exceeding a predetermined temperature, the first contact pad 162 contacts the second contact pad 164, closing the switch and completing a circuit to provide an indication that the heat transfer devices 130 (and the liquid in the internal volume 114) have a temperature higher than the predetermined temperature.

The heat transfer devices 130 may comprise at least one material exhibiting a thermal conductivity greater than about 100 W/m·K, greater than about 200 W/m·K, greater than about 300 W/m·K, or 400 W/m·K at about 20° C.

By way of non-limiting example, the heat transfer devices 130 may be formed of and include one or more of copper, manganese, nickel, iron, chromium, steel, zinc, tin, brass (e.g., an alloy of copper and zinc), bronze (an alloy or copper and tin). In some embodiments, the heat transfer devices 130 individually comprise an alloy of manganese, copper, and nickel; another alloy comprising nickel and iron; and a third alloy comprising chromium and iron.

Figure 1D:
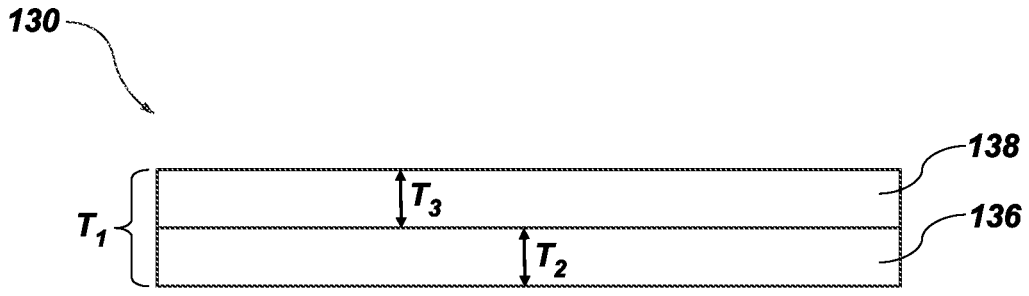
FIG. 1D is a simplified partial cross-sectional view of a heat transfer device, in accordance with embodiments of the disclosure.

In some embodiments, the heat transfer devices 130 individually comprise at least two distinct materials, each material exhibiting a different coefficient of thermal expansion (CTE) than the other material. FIG. 1D is a simplified partial cross-sectional view of a heat transfer device 130, in accordance with embodiments of the disclosure. The heat transfer device 130 of FIG. 1D comprises a bi-metallic strip including, for example, a first material 136 (a first layer) and a second material 138 (a second layer) attached to and neighboring the first material 136. The first material 136 may be attached to the second material 138. By way of non-limiting example, the first material 136 may be clad to the second material 138. Since the heat transfer device 130 comprises includes two distinct materials (e.g., the first material 136 and the second material 138) comprising distinct layers, the heat transfer device 130 may be referred to as a "bimetallic" strip. The first material 136 may exhibit a different (e.g., a higher, a lower) coefficient of thermal expansion than the second material 138.

The heat transfer device 130 may have a thickness $T_1$ within a range of from about 127 μm (about 0.005 inch) to about 508 μm (about 0.020 inch), such as from about 127 μm (about 0.005 inch) to about 254 μm (about 0.010 inch), from about 254 μm (about 0.010 inch) to about 381 μm (about 0.015 inch), or from about 381 μm (about 0.015 inch) to about 508 μm (about 0.020 inch). However, the disclosure is not so limited and the thickness $T_1$ may be different than those described above.

The thickness $T_1$ comprises the sum of a thickness $T_2$ of the first material 136 and a thickness $T_3$ of the second material 138. In some embodiments, the thickness $T_2$ of the first material 136 is substantially the same as the thickness $T_3$ of the second material 138. In other embodiments, the thickness $T_2$ of the first material 136 is different than (e.g., less than, greater than) the thickness $T_3$ of the second material 138.

Each of the thickness $T_2$ of the first material 136 and the thickness $T_3$ of the second material 138 may be within a range of from about 63.5 μm (about 0.0025 inch) to about 254 μm (about 0.010 inch). However, the disclosure is not so limited and each of the thickness $T_2$ of the first material 136 and the thickness $T_3$ of the second material 138 may be different than those described above.

The composition of the first material 136 may be different than the composition of the second material 138. In some embodiments, the first material 136 exhibits a different coefficient of thermal expansion than the second material 138. In some such embodiments, responsive to a change in temperature, the first material 136 expands at a different rate than the second material 138, causing the heat transfer device 130 to change in shape (e.g., bend, deform, flex, deflect).

In some embodiments, the first material 136 comprises an alloy of manganese, copper, and nickel; and the second material 138 comprises copper. In some embodiments, the first material 136 comprises an alloy of nickel, chromium, and iron (e.g., about 22 weight percent nickel, about 3 weight percent chromium, and about 75 weight percent iron), and the second material 138 comprises an alloy of nickel and iron (e.g., between about 36 weight percent nickel and about 42 weight percent nickel, and between about 58 weight percent iron and about 64 weight percent iron). In other embodiments, the first material 136 comprises about 25 weight percent nickel, about 8.5 weight percent chromium, and about 66.5 weight percent iron, and the second material 138 comprises between about 36 weight percent nickel and about 50 weight percent nickel and between about 50 weight percent iron and about 64 weight percent iron. In additional embodiments, the first material 136 comprises about 72 weight percent manganese, about 18 weight percent copper, and about 10 weight percent nickel, and the second material 138 comprises about 36 weight percent nickel and about 64 weight percent iron.

In additional embodiments, the first material 136 comprises an alloy of nickel, manganese, and iron (e.g., about 20 weight percent nickel, about 6 weight percent manganese, and about 74 weight percent iron), and the second material 138 comprises an alloy of nickel and iron (e.g., between about 36 weight percent nickel and about 42 weight percent nickel and between about 58 weight percent iron and about 64 weight percent iron).

Figure 1E:
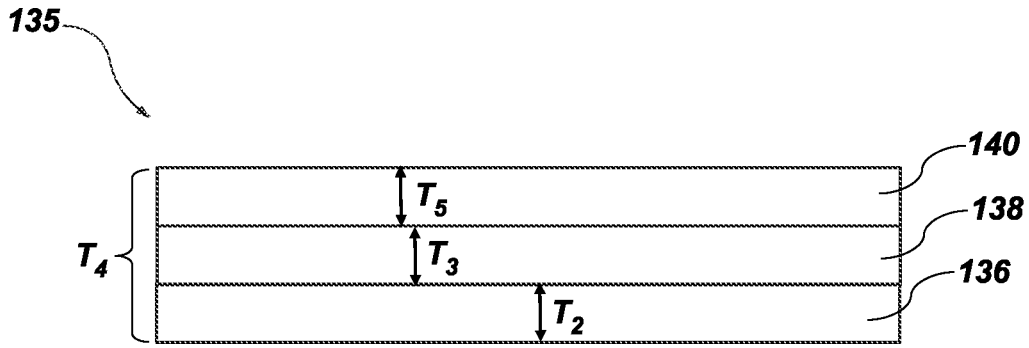
FIG. 1E is a simplified partial cross-sectional view of a heat transfer device, in accordance with embodiments of the disclosure.

FIG. 1E is a simplified partial cross-sectional view of another heat transfer device 135, in accordance with additional embodiments of the disclosure. The heat transfer device 135 may be substantially similar to the heat transfer device 130 (FIG. 1D), except that the heat transfer device 135 may include a third material 140 (e.g., third layer). Since the heat transfer device 135 includes three distinct materials (e.g., the first material 136, the second material 138, and the third material 140) comprising distinct layers, the heat transfer device 135 may be referred to as a "trimetallic" strip.

The third material 140 may be on a side of the second material 138 opposite the first material 136. The third material 140 may comprise one or more of the materials described above with reference to the first material 136 and the second material 138. In some embodiments, each of the first material 136, the second material 138, and the third material 140 comprises a different material composition. In other embodiments, the first material 136 and the third material 140 comprise substantially the same material composition. In some embodiments, at least one of the first material 136, the second material 138, and the third material 140 exhibits a different coefficient of thermal expansion than the other of the first material 136, the second material 138, and the third material 140. In some embodiments, each of the first material 136, the second material 138, and the third material 140 exhibits a different coefficient of thermal expansion than the other of the first material 136, the second material 138, and the third material 140. In some embodiments, the first material 136 and the third material 140 exhibit substantially the same coefficient of thermal expansion as one another and a different coefficient of thermal expansion than the second material 138.

A thickness $T_4$ of the heat transfer device 135 may comprise a sum of the thickness $T_2$ of the first material 136, the thickness $T_3$ of the second material 138, and a thickness $T_5$ of the third material 140. The thickness $T_5$ of the third material 140 may be substantially the same as the thickness $T_2$ of the first material 136, described above.

In some embodiments, the first material comprises 136 an alloy of manganese, copper, and nickel (e.g. about 72 weight percent manganese, about 18 weight percent copper, and about 10 weight percent nickel); the second material 138 comprises an alloy of nickel and iron (e.g., about 50 weight percent nickel and about 50 weight percent iron); and the third material 140 comprises a different alloy of nickel and iron (e.g. about 36 weight percent nickel and about 64 weight percent iron). In other embodiments, the first material 136 comprises an alloy of manganese, copper, and nickel (e.g. about 72 weight percent manganese, about 18 weight percent copper, and about 10 weight percent nickel), the second material 138 comprises one of copper or iron, and the third material 140 comprises an alloy of nickel and iron (e.g. about 36 weight percent nickel and about 64 weight percent iron).

In other embodiments, the first material 136 comprises an alloy of manganese, copper, and nickel (e.g., about 25 weight percent nickel, about 8.5 weight percent chromium, and about 66.5 weight percent iron), the second material 138 comprises copper, and the third material 140 comprises an alloy of nickel and iron (e.g., about 40 weight percent nickel and about 60 weight percent iron). In additional embodiments, the first material 136 comprises an alloy of nickel, chromium, and iron (e.g., about 22 weight percent nickel, about 3 weight percent chromium, and about 75 weight percent iron), the second material 138 comprises copper, and the third material 140 comprises an alloy of nickel and iron (e.g., about between about 36 weight percent nickel and about 40 weight percent nickel, and between about 60 weight percent iron and about 64 weight percent iron).

In some embodiments, the first material 136 comprises an alloy of nickel, manganese, and iron (e.g., about 20 weight percent nickel, about 6 weight percent manganese, and about 74 weight percent iron), the second material 138 comprises copper, and the third material 140 comprises an alloy of nickel and iron (e.g., between about 36 weight percent nickel and about 40 weight percent nickel, and between about 60 weight percent iron and about 64 weight percent iron).

In some embodiments, the first material 136 comprises an alloy of nickel, chromium, and iron (e.g., about 22 weight percent nickel, about 3 weight percent chromium, and about 75 weight percent iron), the second material 138 comprises nickel, and the third material 140 comprises an alloy of nickel and iron (e.g., about 42 weight percent nickel and about 58 weight percent iron).

In additional embodiments, the first material 136 comprises an alloy of nickel, chromium, and iron (e.g., about 22 weight percent nickel, about 3 weight percent chromium, and about 75 weight percent iron), the second material 138 comprises an alloy of manganese, copper, and nickel (e.g. about 72 weight percent manganese, about 18 weight percent copper, and about 10 weight percent nickel), and the third material 140 comprises an alloy of nickel and iron (e.g., about 36 weight percent nickel and about 64 weight percent iron).

In some embodiments, since the first material 136, the second material 138, and the third material 140 individually comprise a metal (which may include an alloy), each of the heat transfer devices 130, 135 may be referred to as "metallic strips."

Although particular compositions for each of the first material 136, the second material 138, and the third material 140 for the heat transfer devices 130, 135 have been described, the disclosure is not so limited. The heat transfer devices 130, 135 (and each of the first material 136, the second material 138, and the third material 140) may comprise different materials, as long as the heat transfer devices 130, 135 exhibit a change in shape (e.g., bend, deform, flex, deflect) responsive to exposure to a temperature greater than the predetermined temperature. By way of non-limiting example, in some embodiments, the heat transfer devices 130 comprise a first material 136 (e.g., a first layer) comprising a first metal or alloy having a different coefficient of thermal expansion than a second metal or alloy of the second material 138 (e.g., second layer) such that the heat transfer devices 130 exhibit a change in shape responsive to exposure to a temperature greater than the predetermined temperature. The heat transfer devices 135 may be substantially the same as the heat transfer devices 130, but may include a third material 140 (e.g., a third layer) comprising a third metal or alloy having a different coefficient of thermal expansion than the second material 138. In some embodiments, the third material 140 comprises a different material composition and a different coefficient of thermal expansion than the first material 136. In other embodiments, the third material 140 and the first material 136 comprise substantially the same material composition.

Although the heat transfer devices 130 have been described as comprising the first material 136 and the second material 138; and the heat transfer devices 135 have been described as comprising the first material 136, the second material 138, and the third material 140, the disclosure is not so limited. In other embodiments, the heat transfer devices 130, 135 include more than two layers or more than three layers of different materials and exhibit a change in shape (e.g., bend, deform, flex, deflect) responsive to exposure to a temperature greater than the predetermined temperature. For example, the heat transfer devices 130, 135 may include four layers of distinct material compositions, more than five layers of distinct material compositions, or more than six layers of distinct material compositions.

In some embodiments, each of the heat transfer devices 130, 135 comprises substantially the same material composition as each of the other heat transfer devices 130, 135. In other embodiments, at least one of the heat transfer devices 130, 135 comprises a different material composition as at least another of the heat transfer devices 130, 135. In some such embodiments, the predetermined temperature of at least one of the heat transfer devices 130, 135 may be different than the predetermined temperature of at least another of the heat transfer devices 130, 135 and the at least one of the heat transfer devices 130, 135 may contact the outer vessel 115 at a different temperature than the at least another of the heat transfer devices 130, 135.

With reference back to FIG. 1B, in some embodiments, the heat transfer devices 130, 135 are attached to the outer surface 117 of the inner wall 116 such that the material exhibiting a relatively higher coefficient of thermal expansion is placed closer to the inner vessel 105 (e.g., faces the inner vessel 105) and the material exhibiting a relatively lower coefficient of thermal expansion is oriented closer to the outer vessel 115 (e.g., facing the outer vessel 115). However, the disclosure is not so limited and the orientation of the heat transfer devices 130, 135 may be different than those described.

In some embodiments, a ratio of the distance D (FIG. 1B, FIG. 1C) between the inner vessel 105 and the outer vessel 115; and the thickness $T_1$ (FIG. 1D) of the heat transfer devices 130 (or the thickness $T_4$ (FIG. 1D) of the heat transfer devices 135 (FIG. 1E)) may be within a range of from about 1.5:1.0 to about 20.0:1.0, such as from about 1.5:1.0 to about 5.0:1.0, from about 5.0:1.0 to about 10.0:1.0, from about 10.0:1.0 to about 15.0:1.0, or from about 15.0:1.0 to about 20.0:1.0.

Figure 1F:
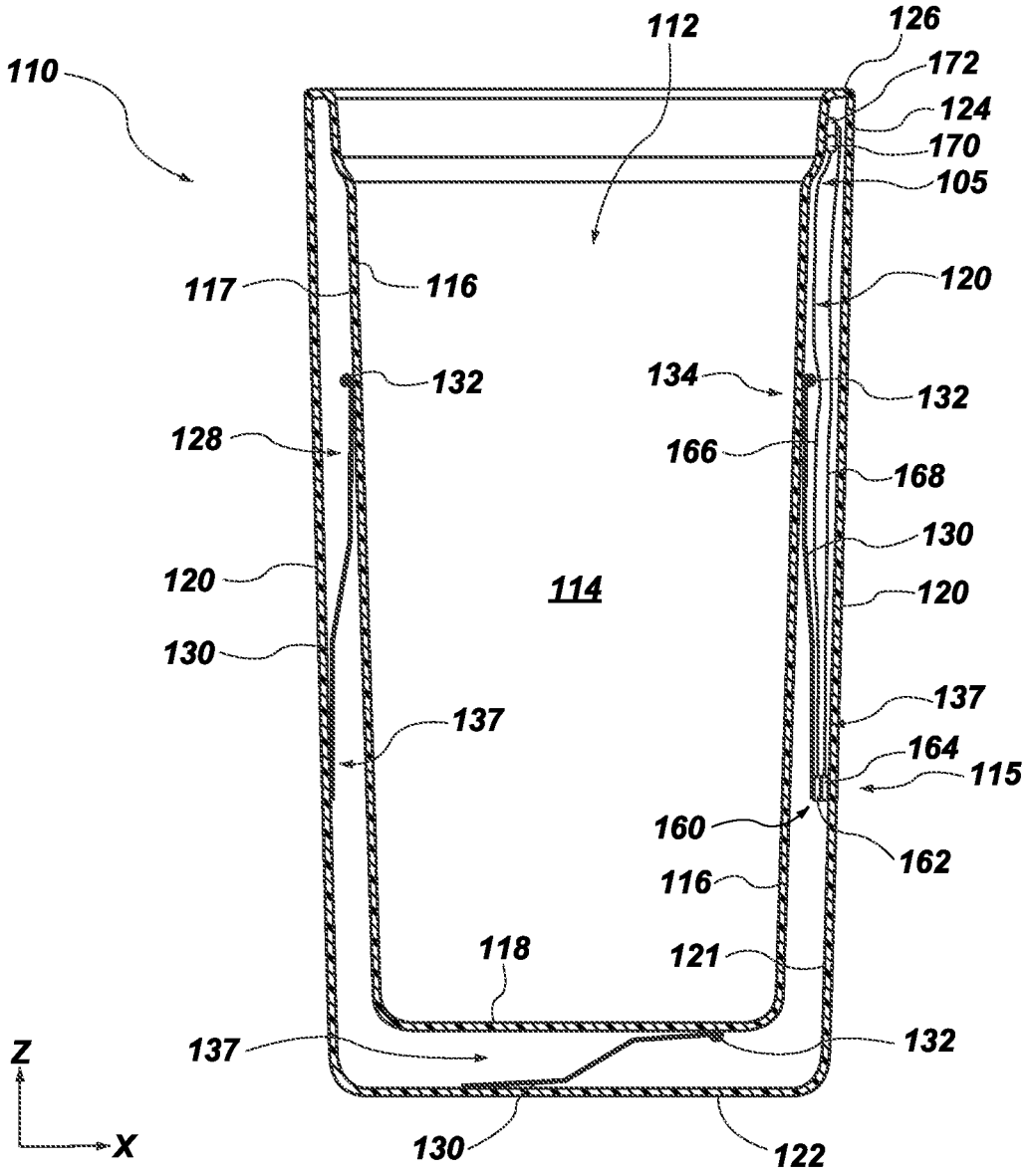
FIG. 1F is a simplified partial cross-sectional view of the insulated container of FIG. 1B when the heat transfer devices are exposed to an elevated temperature.

FIG. 1F is a simplified partial cross-sectional view of the insulated container 110 responsive to placing a liquid (e.g., coffee, tea, hot water) having a temperature greater than the predetermined temperature in the internal volume 114. With reference to FIG. 1F, heat is transferred from the liquid to the inner wall 116 and the internal lower surface 118, and from the inner wall 116 and the internal lower surface 118 to the heat transfer devices 130, 135 attached thereto. Accordingly, the inner wall 116 and the internal lower surface 118 conduct heat to the heat transfer devices 130, 135 attached to the inner vessel 105. If the temperature of the heat transfer devices 130, 135 exceeds the predetermined temperature, the heat transfer devices 130, 135 expand and change shape (e.g., bend, deform, flex, deflect) to contact a surface of the outer wall 120 (e.g., the outer wall 120, the external lower surface 122). Responsive to contacting the outer vessel 115, thermal energy is transferred from the heat transfer devices 130, 135 to the outer vessel 115 by conductive thermal transfer and from the outer vessel 115 to the external environment to facilitate cooling of the liquid in the internal volume 114. Below the predetermined temperature, the heat transfer devices 130, 135 may not contact the outer vessel 115 and may remain spaced from the outer vessel 115 such that thermal energy is not transferred from the heat transfer devices 130, 135 to the outer vessel 115 by conductive thermal transfer.

The predetermined temperature may be a temperature above which it may be unsafe to consume the liquid. For example, the predetermined temperature may be a temperature at which a consumer may burn their mouth drinking the liquid. The predetermined temperature may be about 50° C. (about 122° F.), about 55° C. (about 131° F.), about 60° C. (about 140° F.), about 65° C. (about 149° F.), or about 70° C. (about 158° F.). Accordingly, at temperatures greater than about 50° C. (about 122° F.), about 55° C. (about 131° F.), about 60° C. (about 140° F.), about 65° C. (about 149° F.), or about 70° C. (about 158° F.), the heat transfer device 130, 135 may extend from the inner wall 116 and contact the outer wall 120 to facilitate conductive heat transfer from the inner wall 116 to the outer wall 120. In some embodiments, the predetermined temperature is within a range of from about 60° C. (about 140° F.) to about 70° C. (about 158° F.). Below the predetermined temperature, the heat transfer devices 130, 135 may not contact the outer wall 120.

The switch 160 may be configured to provide an indication that the liquid in the internal volume 114 is greater than the predetermined temperature and unsafe for consumption (e.g., drinking). By way of non-limiting example, responsive to exceeding the predetermined temperature, the heat transfer device 130, 135 to which the first contact pad 162 is attached deforms such that the first contact pad 162 contacts the second contact pad 164. In some embodiments, when the first contact pad 162 contacts the second contact pad 164 (e.g., when the temperature of the heat transfer device 130, 135 is greater than the predetermined temperature) the switch 160 may be in a closed position (e.g., on), completing a circuit, such that a signal (e.g., a voltage) may pass between the first contact pad 162 and the second contact pad 164.

In some embodiments, the lid 150 (FIG. 1A) includes a circuit configured to provide an indication that the heat transfer devices 130, 135 are contacting the outer wall 120 and that, therefore, the temperature of the liquid in the internal volume 114 is greater than the predetermined temperature. By way of non-limiting example, in some embodiments, the lid includes a package comprising a circuit including a battery, a resistor, and a light (e.g., a light emitting diode (LED)) to provide an indication that the temperature of the liquid in the internal volume is unsafe for consumption (e.g., too hot). In some embodiments, the first contact 170 is in electrical communication with (e.g., in contact with) a terminal of the battery (such as by means of a third contact pad connected to the terminal by a wire) of the lid 150. The second contact 172 may be in electrical communication with (e.g., in contact with) the resistor (such as by means of a contact pad connected to the resistor by a wire) of the lid 150. In some embodiments, the resistor is operably coupled to the light and a second terminal of the battery is operably coupled to the light. In use and operation, the first contact 170 and the second contact 172 are placed in communication with a respective third contact pad and fourth contact pad of the lid 150 when the lid 150 is placed over the insulated container 110. When the first contact pad 162 contacts the second contact pad 164, the switch 160 is in the closed position, completing the circuit. When the switch is closed and the circuit is complete, the light in the lid 150 is on, providing a visual indication that the liquid in the internal volume 114 is too hot to drink.

Although FIG. 1B, FIG. 1C, and FIG. 1F illustrate a particular orientation of the heat transfer devices 130 on the inner wall 116, the disclosure is not so limited. For example, although FIG. 1B illustrates the heat transfer devices 130 attached to the inner wall 116 at upper portions of the inner wall 116 (e.g., proximate the opening 112) the disclosure is not so limited.

Figure 2B:
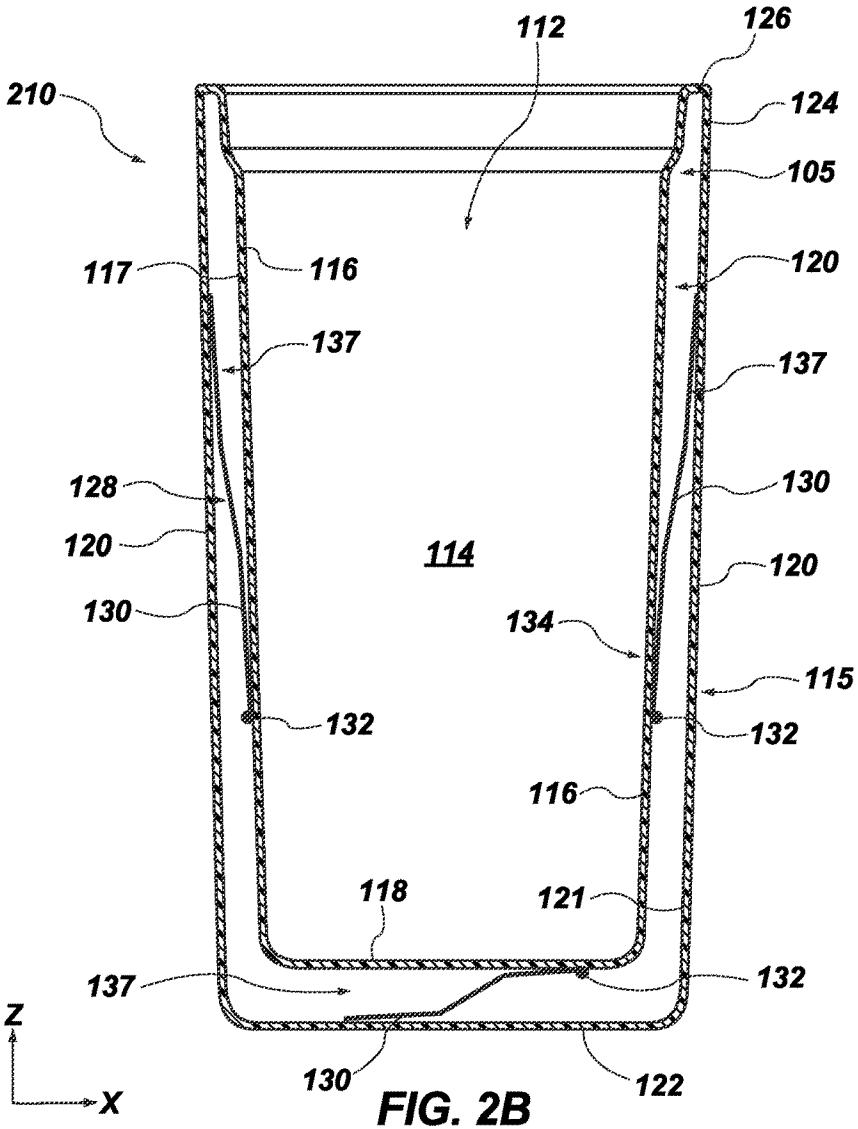
FIG. 2A and FIG. 2B are simplified partial cross-sectional views of an insulated container, in accordance with embodiments of the disclosure.
Figure 2A:
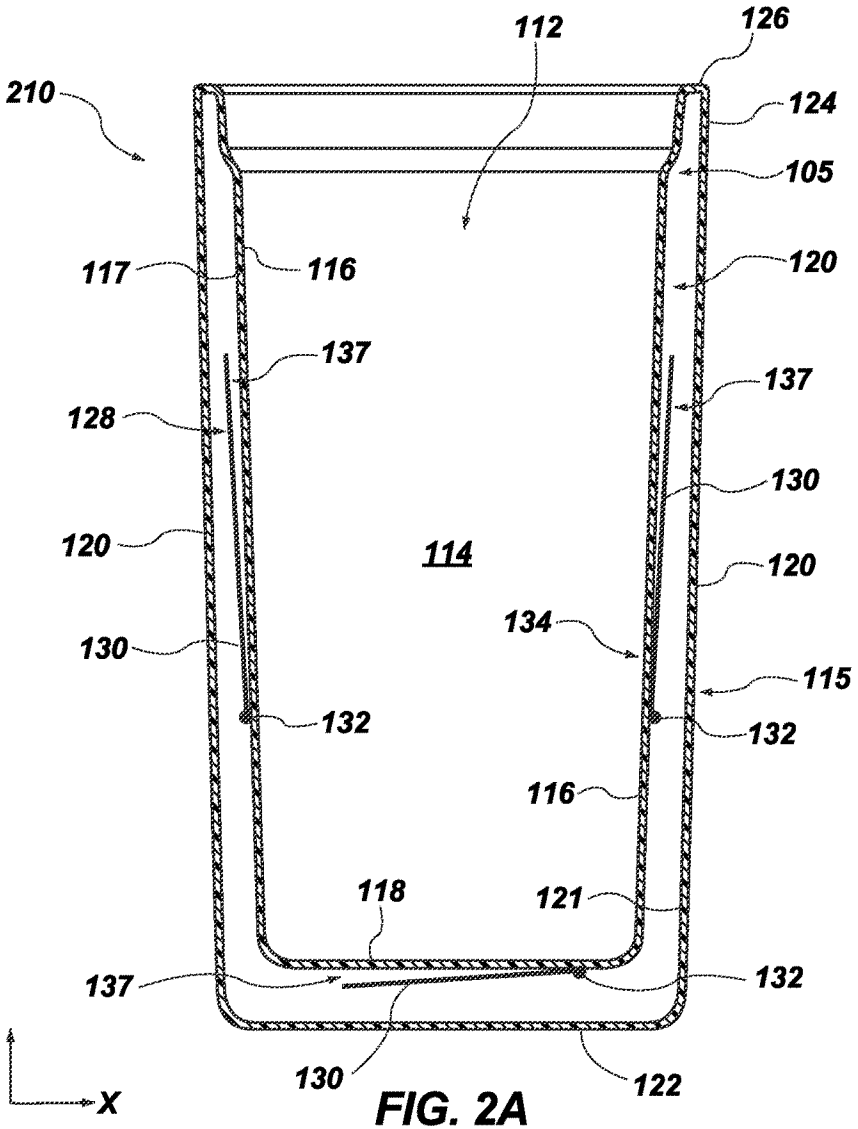

FIG. 2A is a simplified partial cross-sectional view of an insulated container 210, in accordance with embodiments of the disclosure. The insulated container 210 may be substantially the same as the insulated container 110 of FIG. 1B, except that the heat transfer devices 130 may be attached to the inner wall 116 proximate the internal lower surface 118 and distal from the upper portion 124. The heat transfer devices 130 may be attached to the inner wall 116 such that the first end 134 of the heat transfer devices 130 attached to the inner wall 116 at the joints 132 are distal from the upper portion 124 relative to the second end 137 of the respective heat transfer device 130.

FIG. 2B is a simplified partial cross-sectional view of the insulated container 210 after placing a liquid having a temperature greater than the predetermined temperature in the internal volume 114 such that the heat transfer devices 130 exceed the predetermined temperature and exhibit a change in shape to contact the outer vessel 115. With reference to FIG. 2B, responsive to placing the liquid in the liquid in the insulated container 210, thermal energy is transferred from the inner vessel 105 to the heat transfer devices 130, causing the heat transfer devices 130 to change in shape (e.g., bend, deform, flex, deflect) and contact the outer vessel 115. The thermal energy is conductively transferred from the heat transfer devices 130 to the outer vessel 115 until the temperature of the heat transfer devices 130 (and thus, the liquid in the internal volume 114) falls below the predetermined temperature and the heat transfer devices 130 no longer contact the outer vessel 115.

Figure 3B:
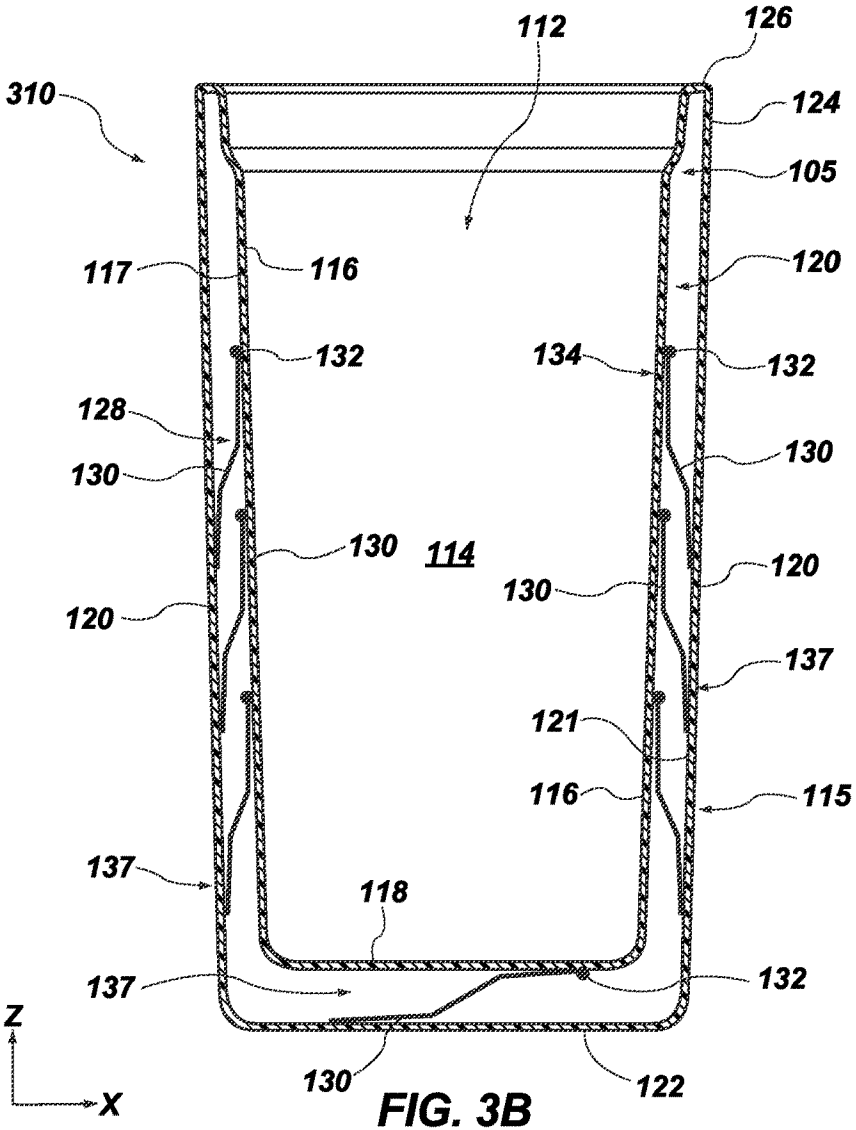
FIG. 3A and FIG. 3B are simplified partial cross-sectional views of an insulated container, in accordance with additional embodiments of the disclosure.
Figure 3A:
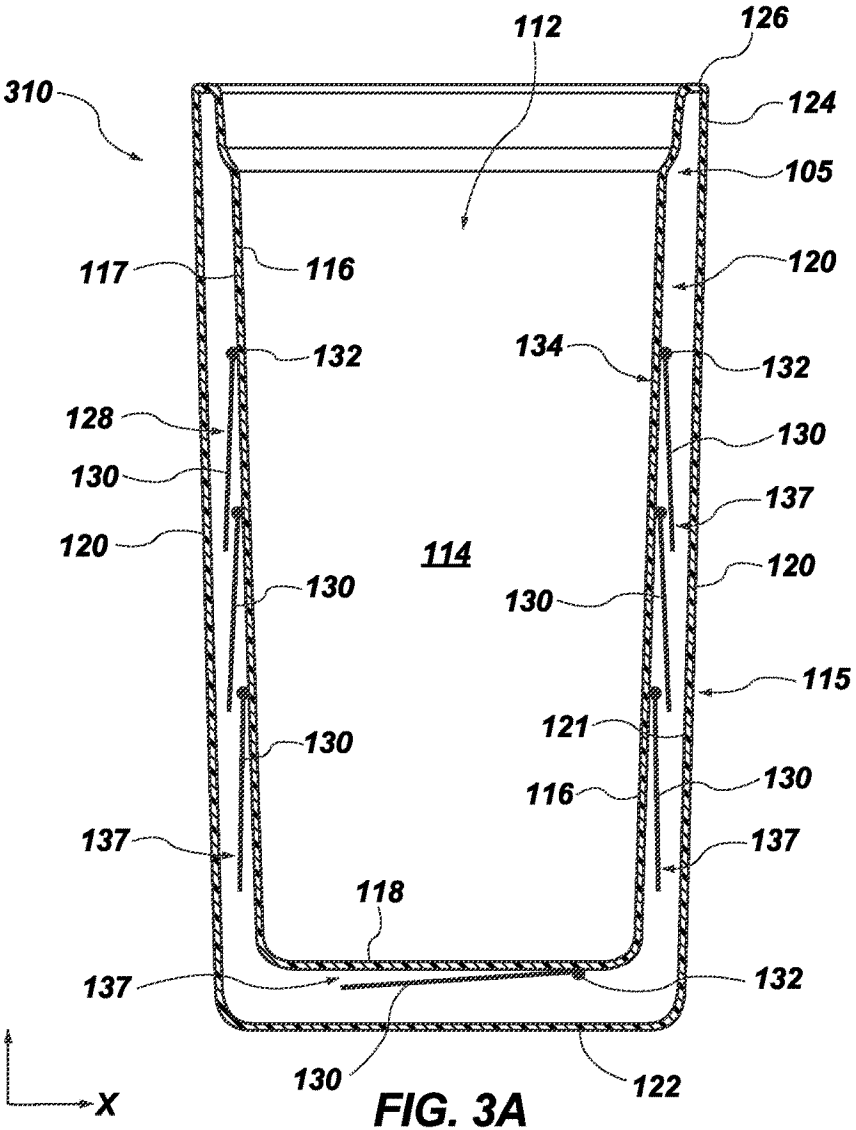

FIG. 3A is a simplified partial cross-sectional view of an insulated container 310, in accordance with embodiments of the disclosure. The insulated container 310 may be substantially the same as the insulated container 110 of FIG. 1B, except that multiple heat transfer devices 130 may be attached to the inner wall 116 at multiple locations and distances from the opening 112 and the upper portion 124.

In some embodiments, the heat transfer devices 130 are attached to the inner wall 116 at different distances from the opening 112 (e.g., different vertical heights) along a height of the insulated container 310. In some embodiments, vertically neighboring heat transfer devices 130 vertically overlap (e.g., in the Z-direction) one another and may be referred to as "nested" heat transfer devices. In some such embodiments, a second end 137 of a first heat transfer device 130 not attached to the inner wall 116 may vertically overlap a second heat transfer device 130 (e.g., a first end 134 of the second heat transfer device 130) and be located farther from the opening 112 than the first end 134 of the second heat transfer device 130.

In other embodiments, vertically neighboring heat transfer devices 130 do not vertically overlap one another. In some such embodiments, a second end 137 of a first heat transfer device 130 not attached to the inner wall 116 may be closer to the opening 112 than the first end 134 of the second heat transfer device 130. In some embodiments, some of the vertically neighboring heat transfer devices 130 vertically overlap one another and other vertically neighboring heat transfer devices 130 do not vertically overlap one another.

In some embodiments, each of the heat transfer devices 130 exhibits substantially the same length (e.g., a longest dimension thereof). In other embodiments, at least some of the heat transfer devices 130 exhibit a different length than at least other of the heat transfer devices 130.

Figure 4:
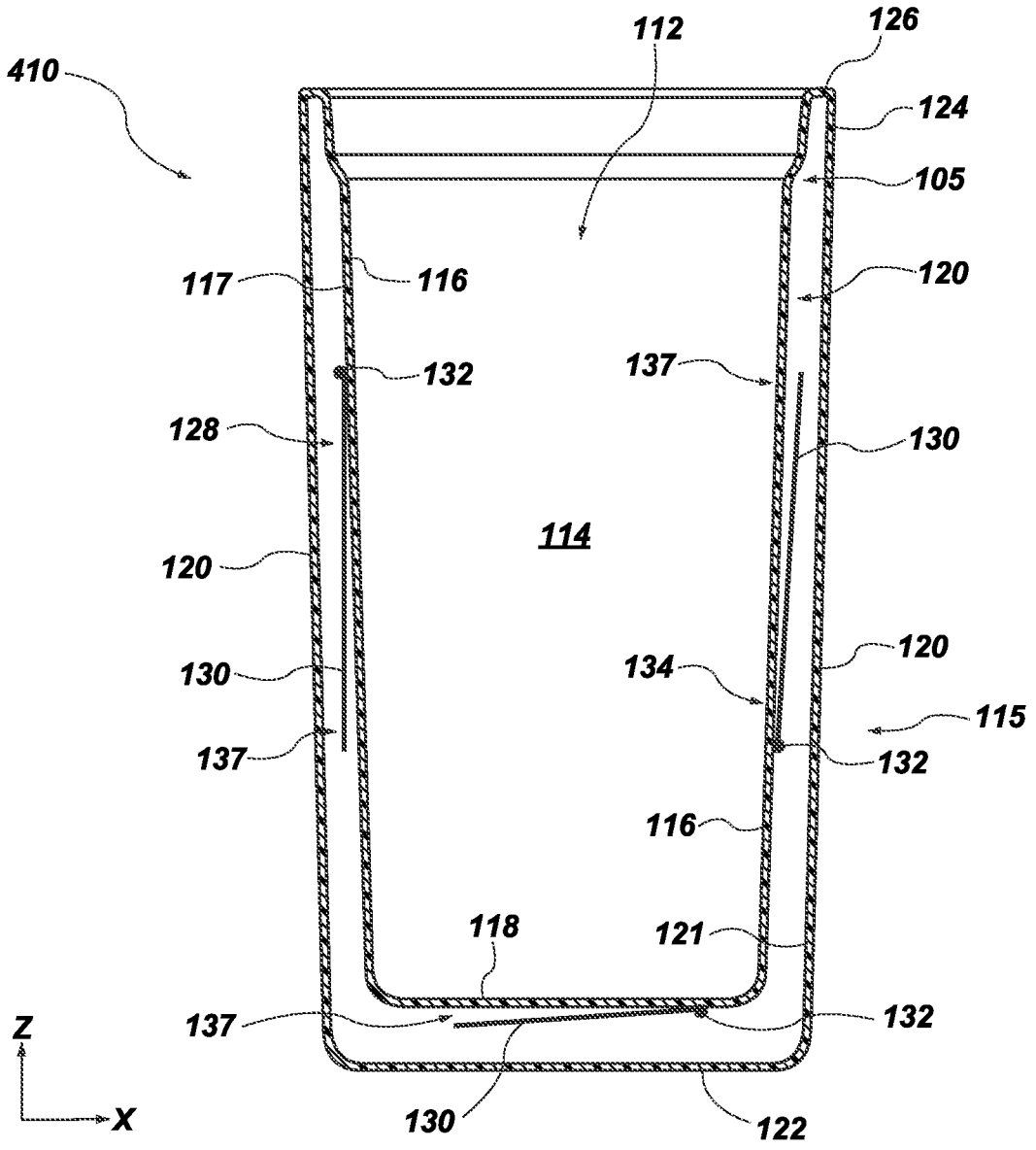
FIG. 4 is a simplified partial cross-sectional view of an insulated container, in accordance with embodiments of the disclosure.

FIG. 4 is a simplified partial cross-sectional view of an insulated container 410, in accordance with embodiments of the disclosure. The insulated container 410 may be substantially the same as the insulated container 110 of FIG. 1B and the insulated container 210 of FIG. 2A, except that some of the heat transfer devices 130 may be attached to the inner wall 116 proximate the upper portion 124 and others of the heat transfer devices 130 are attached to the inner wall 116 proximate the internal lower surface 118. In some such embodiments, when the heat transfer devices 130 exceed the predetermined temperature, some of the heat transfer devices 130 contact the outer wall 120 proximate the upper portion 124 and others of the heat transfer devices 130 contact the outer wall 120 proximate the external lower surface 122.

Although FIG. 1B, FIG. 1E, and FIG. 2A through FIG. 4 have been described and illustrated as comprising the heat transfer devices 130, the disclosure is not so limited. One or more of the heat transfer devices 130 of each of FIG. 1B, FIG. 1E, and FIG. 2A through FIG. 4 may be replaced with the heat transfer device 135 (FIG. 1E). In some embodiments, the insulated containers 110, 210, 310, 410 may include one or more of the heat transfer devices 130, and one or more of the heat transfer devices 135.

Although the insulated containers 110, 210, 310, 410 have been described and illustrated as including the heat transfer devices 130, 135 having a particular structure, the disclosure is not so limited. In other embodiments, the heat transfer devices 130, 135 comprise a shape-memory alloy (SMA) (also referred to as a "memory material," a "memory alloy," a "smart alloy," a "smart metal," or "muscle wire"). In some such embodiments, the heat transfer devices 130, 135 are configured to be deformed at a lower temperature and return to a "pre-deformed" (e.g., a "remembered") shape responsive to having a temperature greater than the predetermined temperature. In some embodiments, the heat transfer devices 130, 135 comprise one or more of an alloy of nickel and titanium (e.g., from about 49 atomic percent nickel to about 51 atomic percent nickel and from about 49 atomic percent titanium to about 51 atomic percent titanium (e.g., about 50 atomic percent nickel and about 50 atomic percent titanium)); an alloy of nickel and aluminum (e.g., from about 36 atomic percent nickel to about 38 atomic percent aluminum, the remainder comprising nickel); an alloy of gold and cadmium (e.g., from about 46.5 atomic percent cadmium to about 50 atomic percent cadmium, the remainder comprising gold); an alloy of copper, aluminum, and nickel (e.g., from about 14 weight percent aluminum to about 14.5 weight percent aluminum, from about 3 weight percent nickel to about 4.5 weight percent nickel, the remainder comprising copper); or an alloy of indium and titanium (e.g., about 18 atomic percent titanium to about 23 atomic percent titanium, the remainder comprising indium). In some embodiments, the shape-memory alloy may be trained to be spaced from the outer vessel 115 at ambient temperatures and configured (e.g., "trained") to deform and contact the outer vessel 115 responsive to exposure temperatures greater than the predetermined temperature.

Although the insulated containers 210, 310, 410 have not been illustrated as including the switch 160 including the first contact pad 162, the second contact pad 164, the first wire 166, the second wire 168, the first contact 170, and the second contact 172, the disclosure is not so limited. It will be understood that one of the heat transfer devices 130, 135 of each of the insulated containers 210, 310, 410 may include the first contact pad 162, and the insulated containers 210, 310, 410 each includes the components of the switch 160 to facilitate providing a visible indication that the temperature of the liquid in the internal volume 114 is greater than the predetermined temperature.

Accordingly, the insulated containers 110, 210, 310, 410 may be configured such that responsive to contact with a liquid in the internal volume 114 (e.g., placement of a liquid in the internal volume 114), thermal energy is transferred through the inner wall 116 and the internal lower surface 118 to the heat transfer devices 130, 135. Responsive to exceeding the predetermined temperature, the heat transfer devices 130, 135 may contact the outer vessel 115 to facilitate conductive thermal transfer from the inner vessel 105 to the outer vessel 115 through the heat transfer devices 130, 135. After the temperature of the liquid in the internal volume 114 is reduced to safe drinking temperatures, the temperature of the heat transfer devices 130, 135 may be lower than the predetermined temperature such that the heat transfer devices 130, 135 do not contact the outer vessel 115 and do not conductively transfer thermal energy to the outer vessel 115. In some such embodiments, the insulated containers 110, 210, 310, 410 exhibit thermally insulated properties to maintain a desired temperature of the liquid for an extended duration (e.g., more than one hour, more than two hours, more than three hours, more than four hours, more than six hours, more than eight hours).

The insulated containers 110, 210, 310, 410 including the heat transfer devices 130, 135 are configured to selectively conductively transfer thermal energy or retain thermally insulative properties. Compared to containers including a phase change material (PCM) around the inner vessel, the insulated containers 110, 210, 310, 410 of embodiments disclosed herein since containers including phase change materials are difficult to manufacture, and the insulated containers with the phase change material may not retain insulative properties.

While embodiments of the disclosure may be susceptible to various modifications and alternative forms, specific embodiments have been shown by way of example in the drawings and have been described in detail herein. However, it should be understood that the disclosure is not limited to the particular forms disclosed. Rather, the disclosure encompasses all modifications, variations, combinations, and alternatives falling within the scope of the disclosure as defined by the following appended claims and their legal equivalents.

What is claimed is:

1. An insulated container for a beverage, the insulated container comprising:

an inner wall defining an opening and a volume, the inner wall configured to contain the beverage in the volume;

an outer wall surrounding the inner wall and defining an annular cavity between the inner wall and the outer wall, the annular cavity enclosed at least by the inner wall and the outer wall and isolated from the volume by the inner wall;

one or more heat transfer devices within the annular cavity and attached to the inner wall, the one or more heat transfer devices spaced from the outer wall and configured to contact the outer wall responsive to exceeding a temperature greater than a predetermined temperature to facilitate conductive heat transfer from the inner wall to the outer wall through the one or more heat transfer devices; and a switch comprising a first contact pad coupled to one of the one or more heat transfer devices and a second contact pad coupled to the outer wall, the switch configured to provide an indication that the temperature of the one or more heat transfer devices is greater than the predetermined temperature responsive to the first contact pad contacting the second contact pad.

2. The insulated container of claim 1, wherein the one or more heat transfer devices comprise one or more bimetallic strips.

3. The insulated container of claim 2, wherein the one or more bimetallic strips exhibits a thermal conductivity greater than about 100 W/m·K at about 20° C.

4. The insulated container of claim 2, wherein the one or more bimetallic strips comprise at least one of:

an alloy of manganese, copper, and nickel; or an alloy of nickel and iron.

5. The insulated container of claim 1, wherein the one or more heat transfer devices are attached to the inner wall by at least one of:

an adhesive;

a mechanical clamp;

a weld;

solder; or braze.

6. The insulated container of claim 1, wherein the predetermined temperature is within a range of from about 60° C. to about 70° C.

7. The insulated container of claim 1, wherein the one or more heat transfer devices comprise:

a first metal; and a second metal attached to the first metal and having a higher coefficient of thermal expansion than the first metal.

8. The insulated container of claim 7, wherein the second metal is closer to the inner wall than the first metal.

9. The insulated container of claim 1, wherein the one or more heat transfer devices comprise a shape-memory alloy.

10. An insulated container, comprising:

an inner vessel comprising:

an internal lower surface; and an inner wall extending from the internal lower surface;

an outer vessel comprising:

an external lower surface; and an outer wall extending from the external lower surface and connected to the inner wall at an upper portion of the insulated container, the inner vessel and the outer vessel converging at an upper portion to define a lip;

one or more heat transfer devices comprising one or more metallic strips attached to the inner vessel and spaced from the outer vessel, the one or more metallic strips within a cavity enclosed by the inner vessel and the outer vessel, the one or more metallic strips configured to:

contact the outer wall to facilitate conductive heat transfer from the one or more metallic strips to the outer vessel responsive to a temperature of a liquid in the inner vessel exceeding a predetermined temperature; and return to a position spaced from the outer vessel responsive to cooling of the liquid in the inner vessel being lower than the predetermined temperature to reduce a rate of conductive heat transfer from the one or more metallic strips to the outer vessel; and a switch comprising a first contact pad coupled to one of the one or more heat transfer devices and a second contact pad coupled to the outer wall, the switch configured to provide an indication that the temperature of the one or more heat transfer devices is greater than the predetermined temperature responsive to the first contact pad contacting the second contact pad.

11. The insulated container of claim 10, wherein the insulated container comprises a vacuum insulated container.

12. The insulated container of claim 10, wherein the one or more metallic strips are formulated and configured to contact the outer vessel responsive to exposure to a temperature greater than about 70° C.

13. The insulated container of claim 10, wherein the one or more metallic strips comprises more than one metallic strip, at least one of the one or more metallic strips having a different size than at least another of the one or more metallic strips.

14. The insulated container of claim 10, wherein the one or more metallic strips comprises more than one metallic strip, at least one of the one or more metallic strips having the same size as at least another of the one or more metallic strips.

15. The insulated container of claim 10, wherein the one or more metallic strips comprises more than one metallic strip, at least one of the one or more metallic strips comprising a different material composition than at least another of the one or more metallic strips.

16. The insulated container of claim 10, wherein the one or more metallic strips comprises a plurality of metallic strips, each metallic strip attached to the inner vessel, the plurality of metallic strips disposed around a circumference of the inner vessel within the cavity between the inner vessel and the outer vessel.

17. The insulated container of claim 10, wherein the one or more metallic strips comprises:

a first metallic strip; and a second metallic strip, the second metallic strip located closer to the upper portion than the first metallic strip.

18. A method of maintaining a temperature of a liquid in an insulated container for a duration, the method comprising:

transferring thermal energy from a liquid in an internal volume through an inner wall to one or more heat transfer devices in contact with the inner wall, the inner wall defining an opening and the internal volume, the internal volume configured to contain the beverageliquid;

increasing the temperature of the one or more heat transfer devices and causing the one or more heat transfer devices to contact an outer wall surrounding the inner wall responsive to exceeding a temperature greater than a predetermined temperature to facilitate conductive heat transfer from the one or more heat transfer devices to the outer wall, the outer wall defining a cavity between the inner wall and the outer wall, the cavity enclosed at least by the inner wall and the outer wall and isolated from the internal volume by the inner wall;

conductively transferring thermal energy from the one or more heat transfer devices to the outer wall;

breaking contact between the one or more heat transfer devices and the outer wall responsive to a temperature of the one or more heat transfer devices being reduced to below the predetermined temperature; and providing an indication that the temperature of the one or more heat transfer devices is greater than the predetermined temperature with a switch comprising a first contact pad coupled to one of the one or more heat transfer devices and a second contact pad coupled to the outer wall responsive to the first contact pad contacting the second contact pad.

19. The method of claim 18, wherein increasing the temperature of the one or more heat transfer devices comprises increasing the temperature of the one or more heat transfer devices comprising three layers.

* * * * *